United States Patent [19]

Sherwin

[11] 4,036,499

[45] July 19, 1977

[54] ARROW BROADHEAD

[76] Inventor: Donald D. Sherwin, 701 Madison, Port Richey, Fla. 33568

[21] Appl. No.: 635,708

[22] Filed: Nov. 26, 1975

[51] Int. Cl.[2] ..... F41B 5/02

[52] U.S. Cl. ..... 273/106.5 B

[58] Field of Search ..... 273/106.5 B, 106 A

[56] References Cited

U.S. PATENT DOCUMENTS

| | | | |
|---|---|---|---|
| 2,338,274 | 1/1944 | Yancey | 273/106 A |
| 2,940,758 | 6/1960 | Richter | 273/106.5 B |
| 3,741,542 | 6/1973 | Karbo | 273/106.5 B |
| 3,904,205 | 9/1975 | Robinson | 273/106 A |

*Primary Examiner*—Paul E. Shapiro

*Attorney, Agent, or Firm*—Stanley M. Miller

[57] ABSTRACT

A broadhead for an arrow comprising a front ferrule section having one or more longitudinal axial slots for the insertion of blades therein, and further having a rear ferrule section which screws into the front ferrule section in order to secure and lock the rear portion of the blade with said front ferrule section and which further serves to allow the broadhead to be connected to the arrow shaft. The lower rear portion of the blade is tapered at the same angle as is the rear tip of the front ferrule piece. The rear ferrule piece has a collet which is tapered at the same angle as the bottom rear of the blade and the front ferrule section and fits over the blade and rear of the front ferrule so as to secure the three pieces as one. The separate tip of the broadhead has a number of clasps on the rear of its shank which locks the tip into the front ferrule section when the tip is force fitted into said ferrule. The tip has a tapered overlapping portion which is tapered at substantially the same angle as the lower front of the blade and front tip of the forward ferrule section, so that the front section of the blade and ferrule is secured in much the same manner as the rear is by the collet.

4 Claims, 5 Drawing Figures

ENLARGED
45°
45°

ARROW BROADHEAD

BACKGROUND OF THE INVENTION

1. Field of the Invention

This invention relates to archery equipment and particularly to broadheads for hunting arrows.

2. Description of the Prior Art.

The arrowhead of the present invention is an improvement over prior art arrowhead construction. As known in the prior art, the broadhead is comprised of a front and rear ferrule section wherein slots in the front ferrule section were used to hold a number of blades. The rear ferrule section and the tip are secured to the front ferrule section by screwing each of them onto projections of the front ferrule section. The front and rear portions of the blade have substantially rectangular lips extending from their lower edge. The tip and rear ferrule section overlap the lips as they screw onto the front ferrule section and thereby secure and lock the blade.

A shortcoming with the broadheads known in the prior art is that the tips of the blade are secured over very narrow rectangular portions of the blade. As a result, the high impact encountered by the broadhead has a tendancy to snap the blades at their weakest section, that being the front and rear tips.

SUMMARY OF THE INVENTION

It is, therefore, an object of this invention to strengthen the impace resistance in arrow broadheads by removing potentially weak points.

A more particular object of this invention is to remove the weak points from the removable blades known in the prior art and to, in general, strengthen the broadhead at weak points in order that it may withstand a much higher impact force.

The present invention overcomes the shortcomings of the prior art and carries out the objects of improving the ability of a broadhead to withstand a high impact. The broadhead of this invention has all of the parts fitting together so as to eliminate weak points. The lower front and rear portions of the blade are tapered at substantially the same angle as the front and rear portions of the ferrule section into which the blades are secured. Furthermore, the rear ferrule section and the broadhead tip also have tapered sections which overlapped the blade and front ferrule, with the tapering of the tip in the rear ferrule section also being at substantially the same angle as the blade and front ferrule. This design removes the awkward extending tips of the blades as shown in the prior art and substantially improves the ability of the broadhead to withstand high impact.

The features of the present invention which are believed to be novel are set forth more particularly in the claims.

BRIEF DISCUSSION OF THE DRAWINGS

In order to better understand the nature and function of the present invention, we refer now to the drawings in which like numerals and characters apply to like parts and in which.

Figures 1, 2, 3, 4, 5:
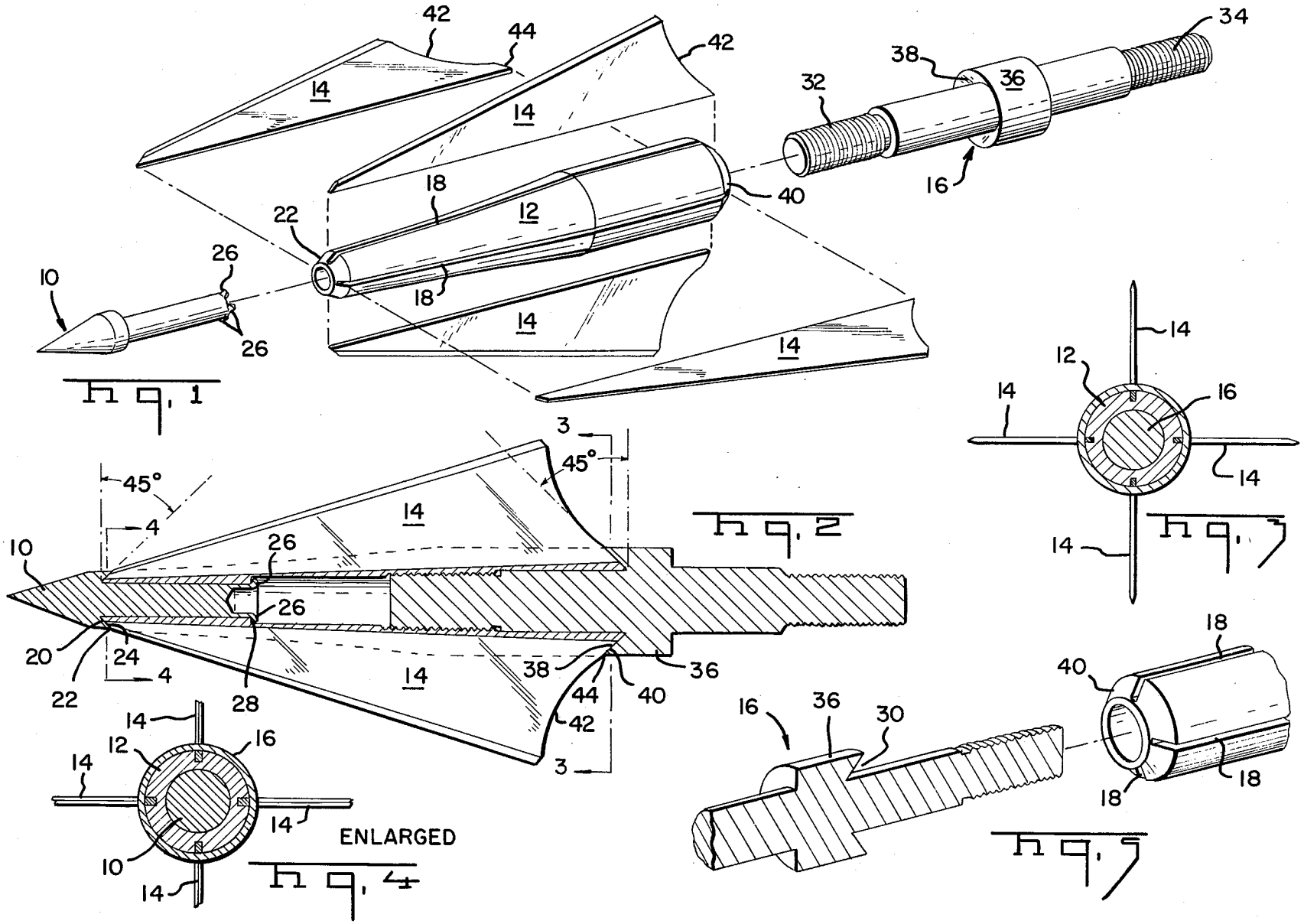
FIG. 1 is an exploded disassembled view of the preferred embodiment of the broadhead of this invention.
FIG. 2 is a cross-sectional view of the broadhead of FIG. 1 when it is assembled.

FIGS. 3 and 4 are cross-sections of the broadhead taken along lines 3—3 and 4—4, as shown in FIG. 2; and FIG. 5 is a partial cross-sectional view from the rear of the broadhead.

DESCRIPTION OF THE PREFERRED EMBODIMENT

Referring first to FIG. 1, the broadhead is composed of four basic parts. The front ferrule section 12 has a number of longitudinal axial slots 18 into which can be inserted various cutting surfaces or blades 14. The tip 10 of the broadhead is force fitted into a front bore section of the ferrule 12. To help secure the tip to the ferrule, the rear end of the shank of the tip has a number of clasps 26 will grasp the inner edge 28 of the front ferrule. The rear section of ferule 12 has a inward coaxial bore with threads thereon which will allow the insertion of a rear ferrule section. Rear ferrule 16 has a front threaded portion 32 and a rear threaded portion 34 to respectively secure said piece to the front ferrule and to the arrow shaft. Rear ferrule 16 has a collet 36 with a tapered section 38 for overlapping and securing the rear of the blade and the front ferrule 12.

As can best be seen in FIG. 2, the blades 14 are the same length as ferrule 12 but do not extend therefrom. The rear of the blade has a short tapered section 44 which is coextensive with the rear tapered section 40 of ferrule 12. This same taper is employed in the taper 38 of collet 36. While it is preferable that all the tapers, represented by numerals 38,40, and 44 be exactly the same, it is realized that in manufacturing these tapers may differ by a few degrees. The preferred angle of the taper on all pieces is 45° in order to maximize the ability of the broadhead to resist impact stress.

A similar design is used in locking and securing the front of the broadhead between the tip 10, ferrule 12 and the blade 14. The tip of the blade has a tapered section 20 which is tapered at the same angle as overlapping tip portion 24 and the front portion 22 of ferrule 12.

The blade has a curved rear section 42 in accordance with various government regulations covering this type of blade. It is easy to see that the tapered rear end of the blade in combination with the rear curved section 42 provides a more uniform surface wherein a higher impact stress can be absorbed than in the protruding tips as known in the prior art. Furthermore, collet 36 by being of expanded width provides additional strength and support along the connection between the rear blade and the front and rear ferrules.

It is thereby seen that an added advantage of this invention is to improve the ability of the broadhead to withstand impact stress and furthermore the construction of the blade and its connection with the broadhead help prevent a blade from being snapped off at any weak point under a high impact stress.

I claim:

1. An improved arrow broadhead comprising in combination:

a rear ferrule adapted to be affixed to an arrow shaft having a collet with a tapered front undercut;

a front ferrule being a hollow tubular body with at least one longitudinal axial slot in its exterior surface, removably secured to one end of said rear ferrule coaxial thereto, and having a rear tapered section to substantially match said tapered front undercut of said rear ferrule, for close engagement therewith, and a front tapered section;

a removable blade placed in said axial slot, projecting from said front ferrule and being substantially the same longitudinal length as said front ferrule, and further having its rear end tapered to substantially match said tapered fron undercut of said rear ferrule, for axial wedging engagement therewith, and its front end tapered to be substantially flush with said front tapered section of said front ferrule;

a tip removable secured to said fron tapered section of said front ferrule and having a tapered undercut section to substantially match said front tapered section of said front ferrule for close engagement therewith and to substantially match said front tapered end of said blade, for axial wedging engagement therewith;

said axial wedging engagement of said blade with said tip and rear ferrule imparting through said front and rear end tapers of said blade, a transverse wedging engagement between said blade and said front ferrule;

whereby the tapered sections of the collet and the tip overlap and wedge the respective tapered ends of the blade to the front ferrule along the respective tapered sections of said front ferrule.

2. An improved arrow broadhead comprising in combination:

a rear ferrule adapted to be affixed to an arrow shaft, said ferrule having a forward coaxial threaded projection and a collet with a tapered front undercut;

a front ferrule being a hollow tubular body with at least one longitudinal axial slot in its exterior surface, said ferrule having a rear coaxial threaded bore for insertion of the threaded projection of said rear ferrule, a front coaxial bore for insertion of a tip thereto, and a rear tpered section to substantially match said tapered front undercut of said rear ferrule, for close engagement therewith, and a front tapered section;

a removable blade placed in said axial slot, projecting from said front ferrule, said blade being substantially the same longitudinal length as said front ferrule and further having its rear end tapered to substantially match said tapered front undercut of said rear ferrule, for axial wedging engagement therewith, and its front end tapered to be substantially flush with said front tapered section of said front ferrule;

a tip having a reduced diameter shank with clasps on the end wherein said tip is adapted to be force fitted into said front bore of said front ferrule with said clasps grasping the end of said bore so as to secure said tip in said bore, said tip having a tapered undercut section in front of said shank to substantially match said front tapered section of said front ferrule for close engagement therewith and to substantially match said front tapered end of said blade, for axial wedging engagement therewith;

said axial wedging engagement of said blade with said tip and rear ferrule imparting through said front and rear end tapers of said blade, a transverse wedging engagement between said blade and said front ferrule;

whereby the tapered sections of the collet and the tapered section of the tip overlap and wedge the blade into the rear and front portions of the front ferrule, respectively.

3. The broadhead in accordance with claim 2 wherein the angle of the taper is 45°.

4. The broadhead in accordance with claim 2 wherein the angle of the taper is between 40° and 50°.

* * * * *